US006464840B1

(12) United States Patent
McCann

(10) Patent No.: US 6,464,840 B1
(45) Date of Patent: Oct. 15, 2002

(54) PACKAGING AND DISPLAYING DEVICE FOR A SPANNER

(75) Inventor: Francis E. McCann, Taichung Hsien (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 0 days.

(21) Appl. No.: 09/703,287

(22) Filed: Nov. 1, 2000

(51) Int. Cl.[7] ..... B65D 75/56

(52) U.S. Cl. ..... 203/349; 206/376; 211/70.6; 248/309.1

(58) Field of Search ..... 206/349, 373, 206/376–378, 493, 495; 211/70.6; 248/309.1

(56) References Cited

U.S. PATENT DOCUMENTS 5,335,772 A * 8/1994 Chervenak et al. ..... 206/349
5,598,924 A * 2/1997 McCann ..... 211/70.6
5,785,174 A * 7/1998 Chow ..... 206/349
5,906,350 A * 5/1999 Kao ..... 206/349
6,186,323 B1 * 2/2001 Jansson et al. ..... 206/349
RE37,129 E * 4/2001 Chow ..... 206/349
6,241,208 B1 * 6/2001 Lin ..... 248/309.1
6,375,005 B1 * 4/2002 McCann ..... 206/349

* cited by examiner

*Primary Examiner*—Bryon P. Gehman
(74) *Attorney, Agent, or Firm*—Akin, Gump, Strauss, Hauer & Feld, L.L.P.

(57) ABSTRACT

A packaging and displaying device for a spanner includes a backing mount member having an annular bearing wall defining a through hole, and an arc-shaped slot. A spanner is adapted to be held on a front wall of the backing mount member by a handle holding member that has a guide key portion extending through the slot to engage a retaining member on a rear wall of the backing mount member. An annular wheel member has a hub engaging a spindle portion of an anchoring member. The spindle portion extends from the rear wall through the through hole to engage fittingly a socket end of a clamped member disposed on the front wall. The clamped member has a nut-shaped clamped portion adapted to be clamped by a clamping head of the spanner.

11 Claims, 8 Drawing Sheets

PACKAGING AND DISPLAYING DEVICE FOR A SPANNER

BACKGROUND OF THE INVENTION

1. Field of the Invention

The invention relates to a packaging and displaying device for a spanner which allows potential customers to try the spanner while the latter remains firmly attached to the device.

2. Description of the Related Art

There is available in the market a type of portable tool box kit that can display tools, such as spanners, sold therewith. However, such a tool box kit does not allow potential customers to try the spanner while the spanner remains attached to the tool box kit.

SUMMARY OF THE INVENTION

Therefore, the main object of the present invention is to provide a packaging and displaying device for a spanner which allows the spanner to be tried while being held firmly thereon.

Accordingly, a packaging and displaying device of this invention is adapted for use with a spanner having a handle with first and second ends opposite to each other, and a clamping head disposed on the first end to apply torque in one direction only. The device includes a backing mount member, an annular wheel member, a ratchet mechanism, an anchoring member, a clamped member, a handle holding member, and a retaining member. The backing mount member has front and rear walls opposite to each other in a transverse direction. The front wall includes a mounting portion with an annular bearing wall to define a through hole having a rotating axis and communicating the front wall with the rear wall, and a guiding portion opposite to the mounting portion in a longitudinal direction. The front wall of the guiding portion defines an arc-shaped slot which extends to communicate the front wall with the rear wall and which is spaced apart from the rotating axis in radial directions. The annular wheel member has a rim portion disposed to be rotatable relative to the annular bearing wall, and a hub portion disposed to surround the rotating axis. The ratchet mechanism is disposed between the rim portion and the annular bearing wall to permit unidirectional rotation of the annular wheel member relative to the annular bearing wall. The anchoring member has an enlarged head portion disposed rearwardly of the rear wall, and a spindle portion with a proximate end disposed normal to the enlarged head portion and insertable into the hub portion to be rotated therewith, and a distal end extending from the proximate end in the transverse direction to extend forwardly of the front wall. The clamped member includes a socket end disposed to engage the distal end by press fitting in the transverse direction, an annular spacer portion disposed outwardly of the socket end and to surround the rotating axis so as to face the front wall when the socket end engages the distal end, and a clamped portion opposite to the annular spacer portion in the transverse direction and adapted to be clamped by the clamping head. The handle holding member includes a grip portion, a guided key portion, and a first coupling end. The grip portion is adapted to grip the second end of the handle so as to bring the clamping head to clamp the clamped portion. The guided key portion extends from the grip portion in the transverse direction and rearward so as to be inserted through and guided by the arc-shaped slot when the clamped portion is rotated with the annular wheel member. The first coupling end extends from the guided key portion in the first direction and rearward so as to extend rearwardly of the rear wall. The retaining member is disposed rearwardly of the rear wall, and includes a second coupling end to engage the first coupling end so as to cooperate with the grip portion, to stabilize movement of the guided key portion in the arc-shaped slot.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
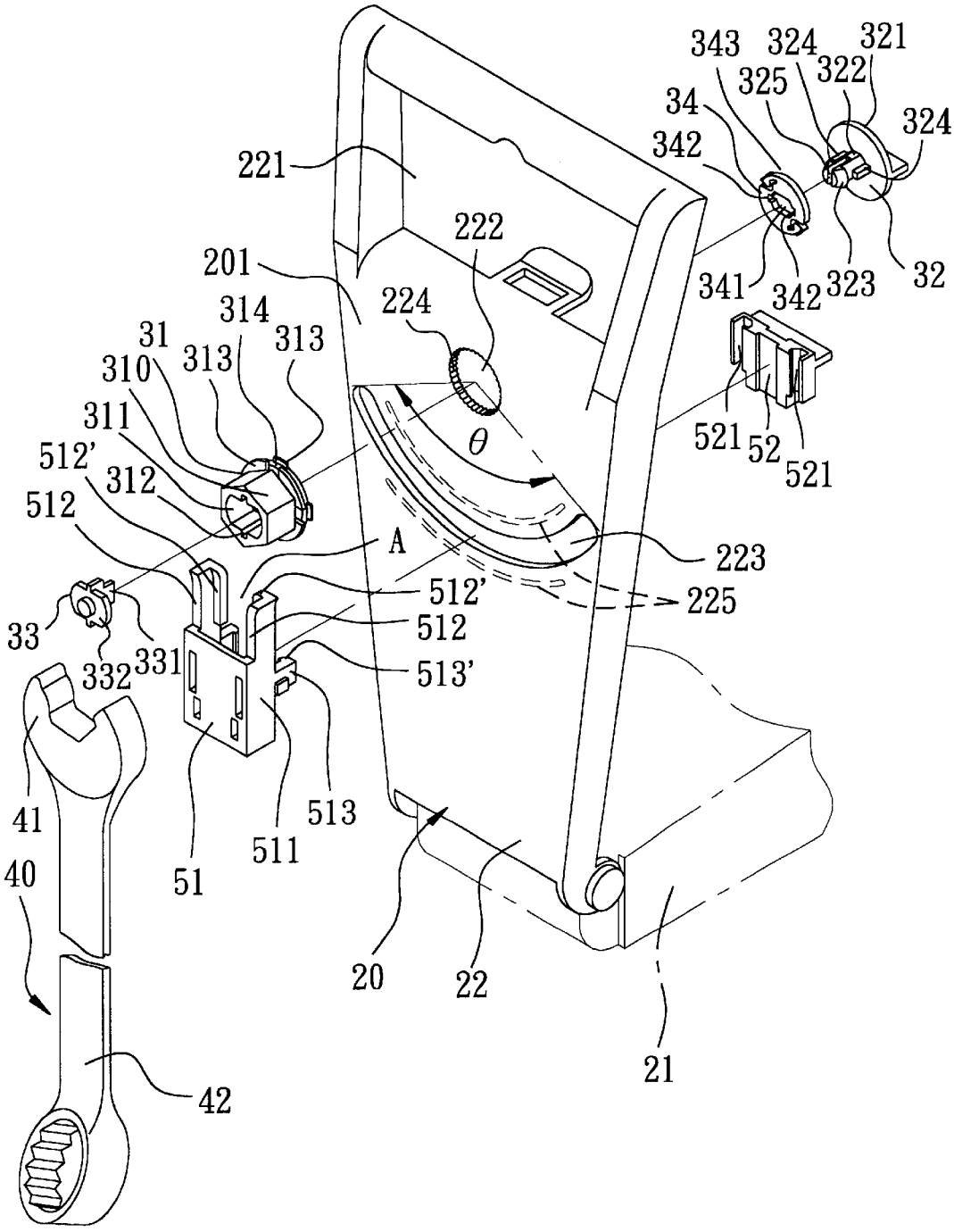
FIG. 1 is an exploded perspective view of the preferred embodiment of a packaging and displaying device for a spanner according to the invention.

Referring to FIGS. 1 to 4, the preferred embodiment of a packaging and displaying device for a spanner 40 is shown to include a backing mount member 20, an annular wheel member 34, a ratchet mechanism, an anchoring member 32, a clamped member 31, a handle holding member 51, and a retaining member 52. The spanner 40 has a handle 42 with first and second ends opposite to each other, and a clamping head 41 disposed on the first end to apply torque in one direction only.

The backing mount member 20 has front and rear walls opposite to each other in a first transverse direction. The front wall includes a mounting portion 201 and a guiding portion 22. The mounting portion 201 includes an annular bearing wall 224 to define a through hole 222 having a rotating axis and communicating the front wall with the rear wall. The annular bearing wall 224 has a plurality of ratchet teeth. The guiding portion 22 is opposite to the mounting portion 201 in a longitudinal direction, and defines an arc-shaped slot 223 that extends to communicate the front wall with the rear wall, and that is spaced apart from the rotating axis in radial directions. The arc-shaped slot 223 has two ends that form an angle θ of at least 60° (70° in this embodiment) with the rotating axis. The rear wall is provided with two guide ribs 225 that are disposed above and below and that are spaced apart from the arc-shaped slot 223 in radial directions. Preferably, the backing mount member 20 is in the form of a cover having a rear side edge hinged to a tool box body 21, and is formed with a grip hole 221 to facilitate lifting thereof from the tool box body 21.

The annular wheel member 34 has a rim portion 343 disposed to be rotatable relative to the annular bearing wall 224, and a hub portion 341 disposed to surround the rotating axis. The rim portion 343 is provided with a plurality of pawl members that cooperate with the ratchet teeth of the annular bearing wall 224 to constitute a ratchet mechanism that permits unidirectional rotation of the annular wheel member 34 relative to the annular bearing wall 224. The pawl members are integrally formed with the rim portion 343 and are configured to be resilient such that the ratchet teeth of the annular bearing wall 224 depress the pawl members inwardly and radially of the rim portion 343 against biasing action of the pawl members when the annular wheel member 34 is rotated unidirectionally. The hub portion 341 is formed with two insert recesses 342 in opposite lateral sides thereof.

The anchoring member 32 is preferably formed from a plastic material, and has an enlarged head portion 321 disposed rearwardly of the rear wall, and a spindle portion 322 with a proximate end disposed normal to the enlarged head portion 321 and insertable into the hub portion 341 to be rotated therewith, and a distal end 323 extending from the proximate end in the first transverse direction to extend forwardly of the front wall. The spindle portion 322 is further provided with two projections 324 extending from opposite lateral sides thereof for engaging the insert recesses 342 in the hub portion 341 so as to position the annular wheel member 34 thereon. The distal end 323 of the spindle 322 is substantially elliptical, and is provided with a split 325 extending from the distal end towards the proximate end in the first transverse direction to allocate some room for deformation thereof when being press fitted into the clamped member 31.

The clamped member 31 includes a socket end 315 (see FIG. 4), an annular spacer portion 313, and a clamped portion 310. The socket end 315 is disposed to engage the distal end 323 of the spindle portion 322 by press fitting in the first transverse direction. The spacer portion 313 is disposed outwardly of the socket end 315 and to surround the rotating axis so as to face the front wall of the backing mount member 20 when the socket end 315 engages the distal end 323. The spacer portion 313 is further provided with an annular groove 314. The clamped portion 310 is opposite to the annular spacer portion 313 in the first transverse direction, and is adapted to be clamped by the clamping head 41 of the spanner 40. The clamped portion 310 includes an inner surrounding wall which defines a cavity 311 extending in the first transverse direction to be communicated with the socket end 315 so as to permit extension of the distal end 323 therethrough, and which includes a guiding groove 312 extending in the first transverse direction. In this embodiment, the clamped portion 310 is in the form of a hexagonal nut.

The packaging and displaying device further includes an insert member 33 disposed to fit into the cavity 311 so as to be positioned forwardly of the distal end 323 of the anchoring member 32. The insert member 33 includes a front portion 332 fitted into the cavity 311, and a locking key portion 331 disposed to extend rearwardly from the front portion 332 and in the first transverse direction to be inserted into the split 325 when the front portion 332 is fitted into the cavity 311. The locking key portion 331 includes a distal segment disposed to be inserted into the split 325, and a proximate segment relative to the front portion 332. When the distal segment is brought to be inserted into the split 325, the proximate segment is brought to register with and is retained in the guiding groove 312.

The handle holding member 51 is preferably formed from a plastic material, and includes a grip portion 511, two guided keyportions 513, and two first coupling ends 513'. The grip portion 511 is adapted to grip the second end of the handle 42 so as to bring the clamping head 41 to clamp the clamped portion 310, and includes a front section having left and right sides and extending in a second transverse direction which is transverse to both of the first transverse direction and the longitudinal direction, and two side sections extending rearwardly from the left and right sides, respectively, in the first transverse direction. The front section and the side sections together define a receiving space (A) for accommodating the handle 42. The receiving space (A) is such that it is smaller than the width of the clamping head 41 but slightly larger than the width of the handle 42. In addition, the side sections extend longitudinally upward to form limiting portions 512, respectively. The limiting portions 512 respectively have limiting strips 512' that extend toward each other in the second transverse direction. The guided key portions 513 extend respectively from the side sections of the grip portion 511 in the first transverse direction and rearward so as to be inserted through and guided by the arc-shaped slot 223 when the clamped portion 310 is rotated with the annular wheel member 34. The first coupling ends 513' extend respectively from the guided key portions 513 in the first transverse direction and rearward so as to extend rearwardly of the rear wall.

Figure 2:
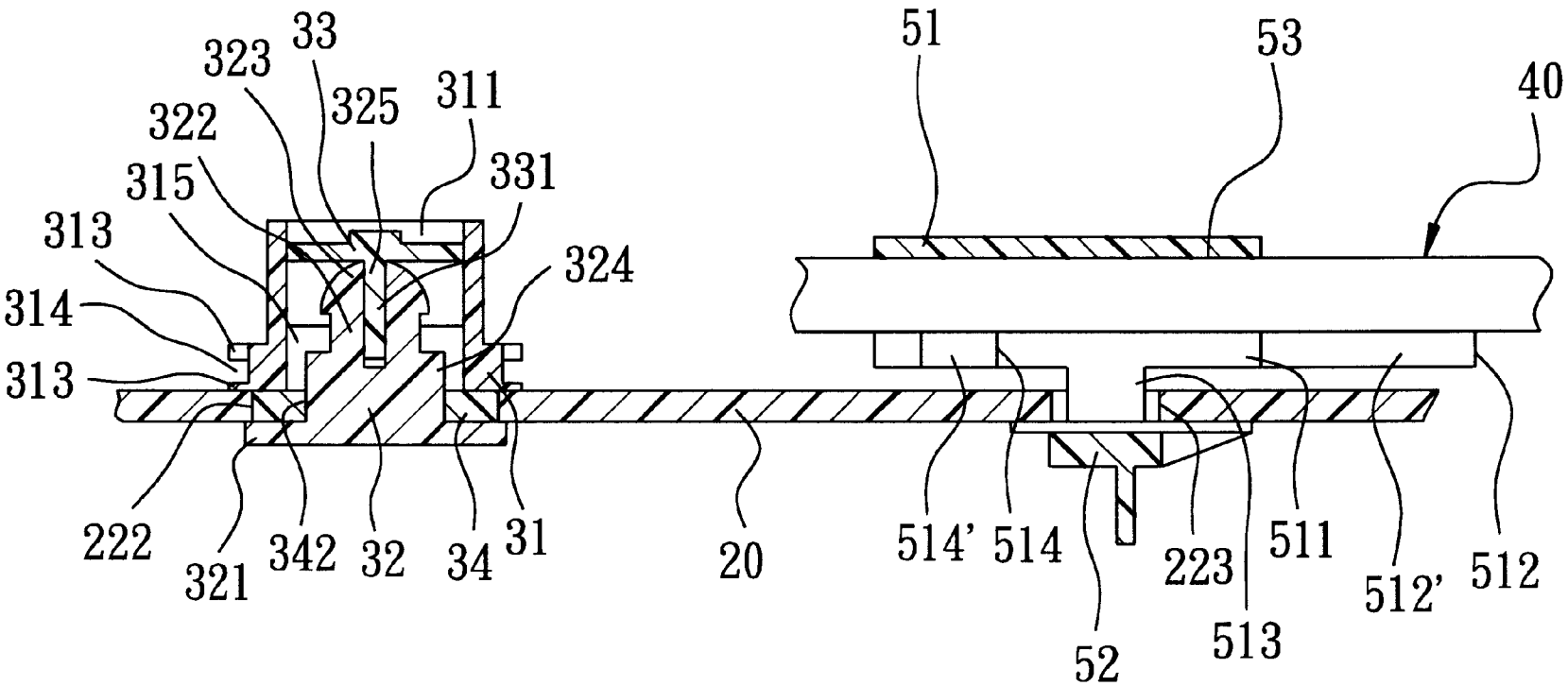
FIG. 2 is a fragmentary sectional view of the preferred embodiment.
Figure 4:
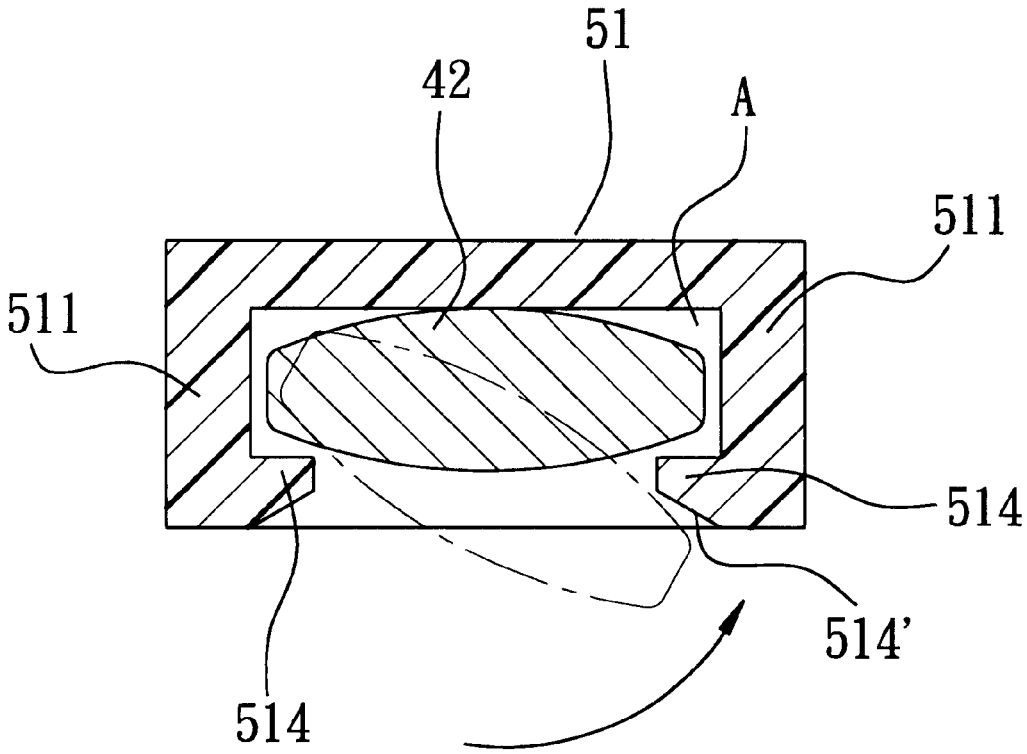
FIG. 4 is a cross-sectional view of the preferred embodiment, taken along line IV—IV of FIG. 3.

Referring to FIGS. 2 and 4, the side sections of the grip portion 511 are respectively provided with limiting blocks 514 that extend toward each other in the second transverse direction, and that are disposed opposite to the limiting portions 512 and flush with the limiting strips 512'. Each limiting block 514 has an outer oblique guide face 514'.

The retaining member 52, preferably formed from a plastic material, is disposed rearwardly of the rear wall, and includes second coupling ends 521 to engage the first coupling ends 513' so as to cooperate with the grip portion 511 to stabilize movement of the guided key portions 513 in the arc-shaped slot 223.

Figure 3:
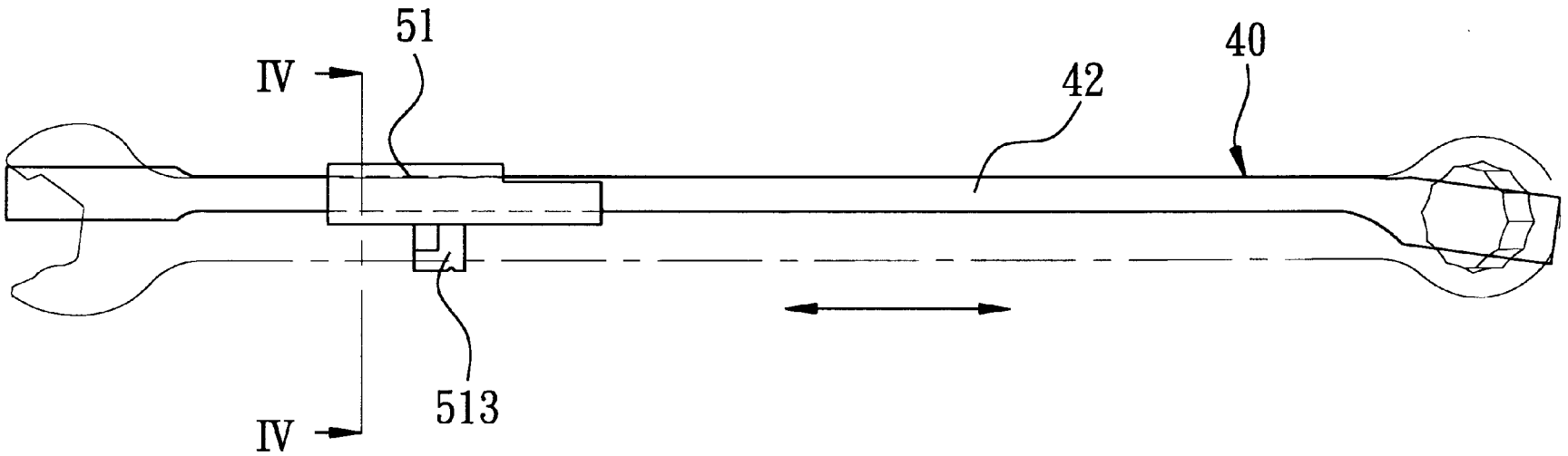
FIG. 3 is a schematic view illustrating how a spanner is inserted into a handle holding member of the preferred embodiment.

During assembly, referring to FIGS. 3 and 4, the spindle portion 322 is extended through the hub portion 341 and the through hole 222. Then, the socket end 315 is aligned with the spindle portion 322, and the distal end 323 of the spindle portion 322 is press fitted into the socket end 315 such that the two projections 324 engage the insert recesses 342. Thereafter, the insert member 33 is fitted into the cavity 311 such that the distal segment thereof is inserted into the split 325 to ensure that the enlarged head portion 323 and the socket end 315 are firmly engaged, and the proximate segment is brought to register with and is retained in the guiding groove 312 to prevent slippage of the insert member 33 from the cavity 311. As such, the annular wheel member 34, the anchoring member 32, and the clamped member 31 can be joined together, with the annular wheel member 34 retained in the through hole 222 by means of the ratchet mechanism. Thereafter, one side of the handle 42 of the spanner 40 is slid slantingly into the receiving space (A), and the spanner 40 is turned at an angle so that the other side of the handle 42, by virtue of the oblique guide face 514', is squeezed into the receiving space (A) as well (see FIG. 4). Subsequently, the two guide key portions 513 are extended through the arc-shaped slot 223 such that the first coupling ends 513' engage the second coupling ends 521 of the retaining member 52 on the opposite side, and such that movement of the retaining member 52 is guided by the guide ribs 225 on the rear wall. As such, the spanner 40 can be held in the handle holding member 51 on the front wall of the backing mount member 20 while being capable of longitudinal displacement.

Figure 5:
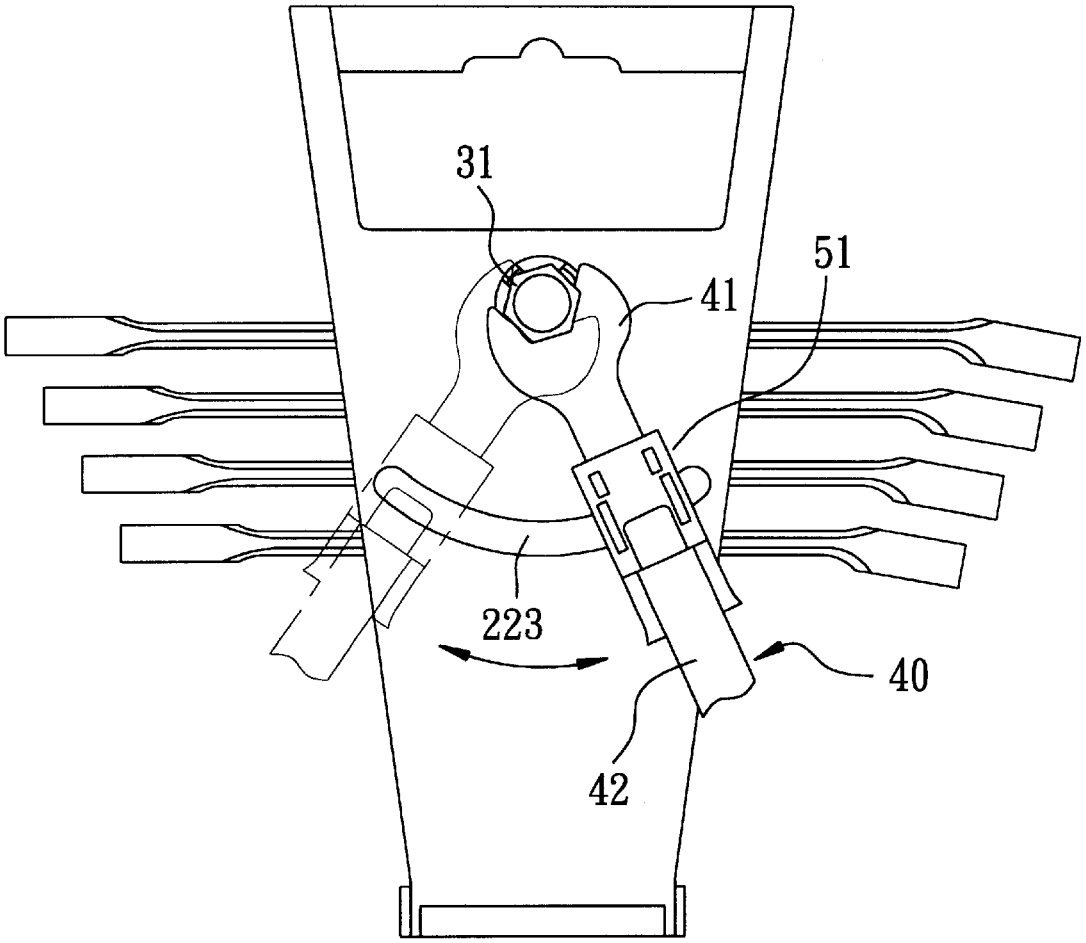
FIG. 5 is a schematic view illustrating the preferred embodiment in a state of use.

When a potential customer wishes to try the spanner 40, he can move the spanner 40 towards the clamped member 31 such that the clamping head 41 clamps the clamped portion 310. Then, the clamped portion 310 can be turned about the rotating axis by swinging the spanner 40 along the path of the arc-shaped slot 223 like a pendulum while the handle 42 thereof is confined within the receiving space (A), as shown in FIG. 5.

Figure 6:
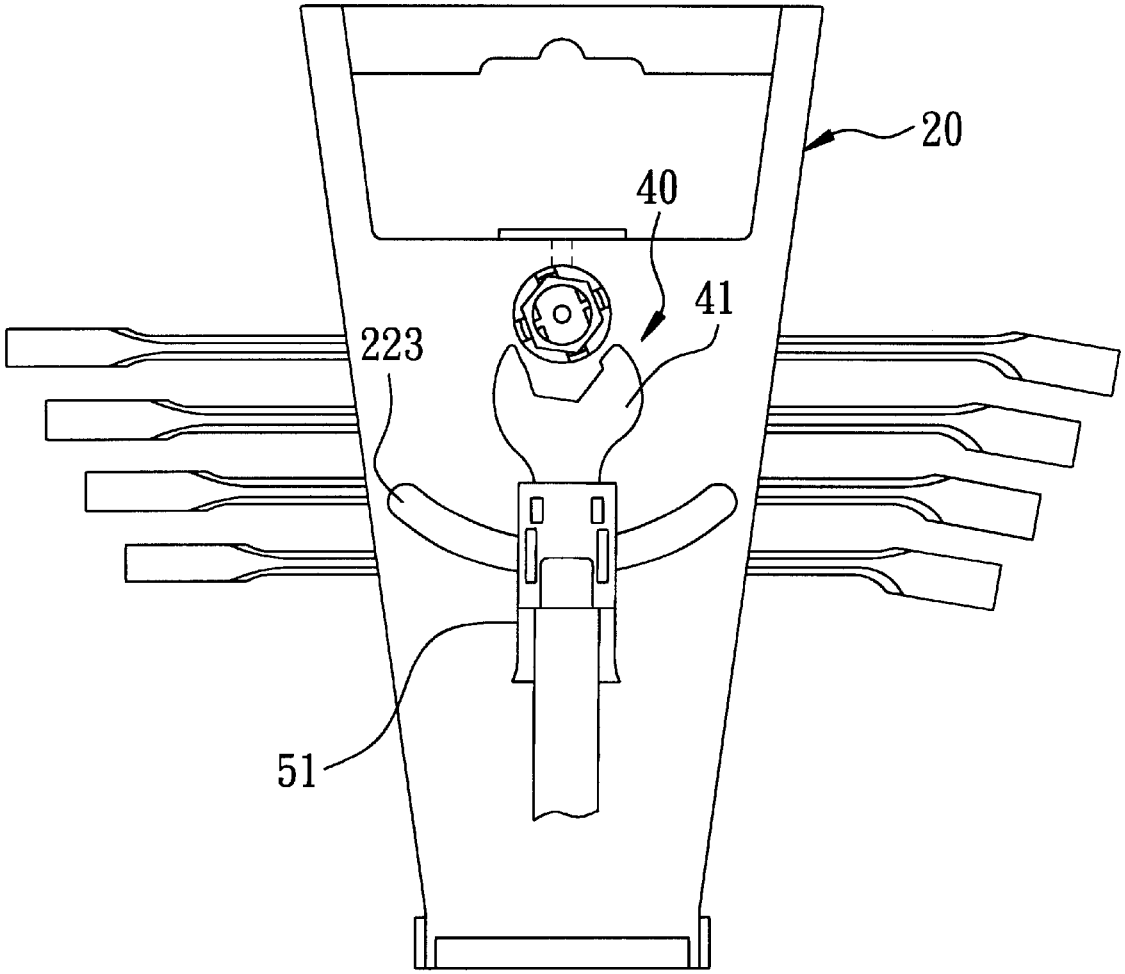
FIG. 6 is a schematic view illustrating the preferred embodiment in a state of display.

Referring to FIG. 6, since the receiving space (A) is smaller than the clamping head 41 of the spanner 40, and since the handle holding member 51 is firmly retained by the retaining member 52, the spanner 40 cannot be easily removed from the backing mount member 20 while being displayed. In order to remove the spanner 40 from the backing mount member 20, the handle holding member 51 has to be disengaged from the retaining member 52 in a reverse process, or has to be broken by force.

Figure 7:
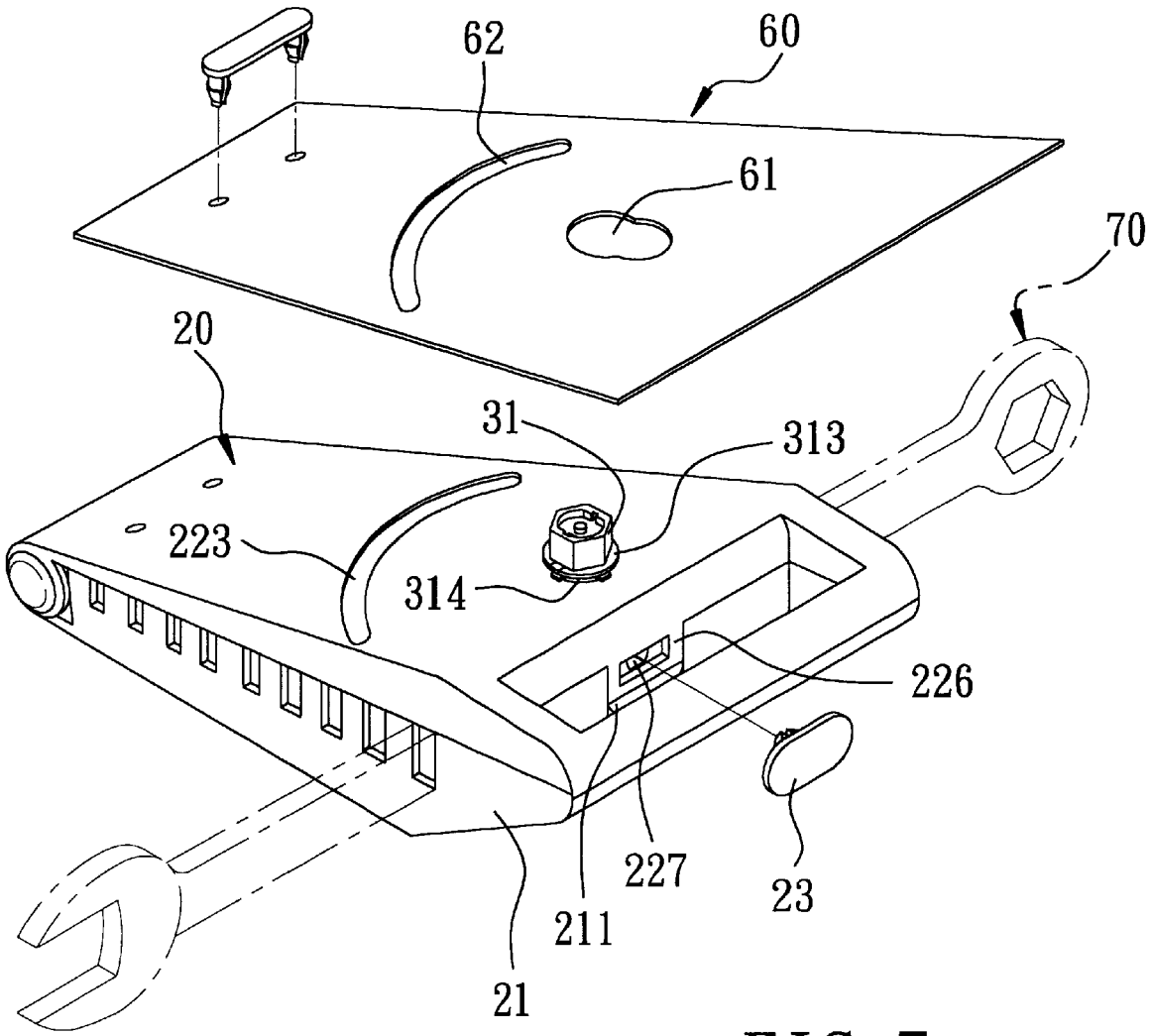
FIG. 7 is a schematic view illustrating how a card is mounted on a backing mount member of the preferred embodiment.

Referring to FIG. 7, a tag 60 of cardboard can be hung on the clamped member 31 to indicate the specifications, functions, and other information of the contents of the tool box body 21, in which a spanner 70 is displayed. The tag 60 is retained in the annular groove 314 of the spacer portion 313, and is provided with a through hole 61 and a slot 62 corresponding to the clamped member 31 and the arc-shaped slot 223, respectively. As illustrated, the tool box body 21 has a front wall provided with a fastening seat 211, and a rivet 23 is extended through a rivet hole 227 in a fastening hook 226 of the backing mount member 20 to prevent lifting of the backing mount member 20 from the tool box body 21.

Figure 8:
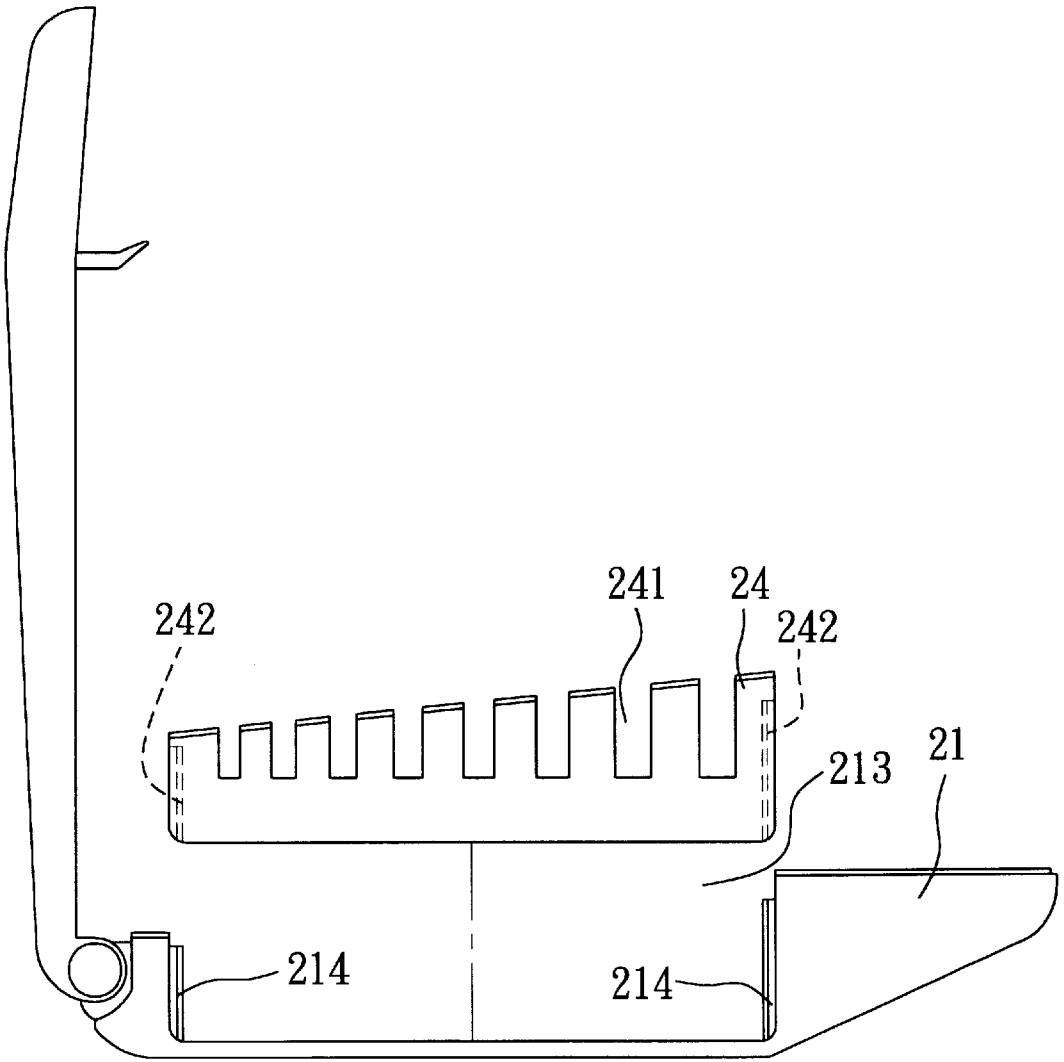
FIG. 8 is a schematic front view illustrating the backing mount member of the preferred embodiment hinged to a tool box body.

Referring to FIG. 8, the tool box body 21 has an open top side, front and rear walls, and two lateral side walls to define a receiving space adapted to receive tools therein. Each of the lateral side walls is formed with a plate mounting groove 213. The tool box body 21 further includes a pair of tool retaining plates 24 slidably and respectively disposed in the plate mounting grooves 213 of the lateral side walls. The tool retaining plates 24 are formed with aligned pairs of notches 241 adapted to support shanks and handles of tools. The tool box body 21 further includes a tenon-and mortise arrangement 214, 242 for removably retaining the tool retaining plates 24 in the plate receiving grooves 213.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A packaging and displaying device for a spanner having a handle with first and second ends opposite to each other, and a clamping head disposed on the first end to apply torque in one direction only, said packaging and displaying device comprising:

a backing mount member having front and rear walls opposite to each other in a first transverse direction, said front wall including a mounting portion with an annular bearing wall to define a through hole having a rotating axis and communicating said front wall with said rear wall, and a guiding portion opposite to said mounting portion in a longitudinal direction, said guiding portion defining an arc-shaped slot extending to communicate said front wall with said rear wall and spaced apart from said rotating axis in radial directions;

an annular wheel member having a rim portion disposed to be rotatable relative to said annular bearing wall, and a hub portion disposed to surround said rotating axis;

a ratchet mechanism disposed between said rim portion and said annular bearing wall to permit unidirectional rotation of said annular wheel member relative to said annular bearing wall;

an anchoring member having an enlarged head portion disposed rearwardly of said rear wall, and a spindle portion with a proximate end disposed normal to said enlarged head portion and insertable into said hub portion to be rotated therewith, and a distal end extending from said proximate end in the first transverse direction to extend forwardly of said front wall;

a clamped member including a socket end disposed to engage said distal end by press fitting in the first transverse direction, an annular spacer portion disposed outwardly of said socket end and to surround the rotating axis so as to face said front wall when said socket end engages said distal end, and a clamped portion opposite to said annular spacer portion in the first transverse direction, and adapted to be clamped by the clamping head;

a handle holding member including a grip portion adapted to grip the second end of the handle so as to bring the clamping head to clamp said clamped portion, a guided key portion extending from said grip portion in the first transverse direction and rearward so as to be inserted through and guided by said arc-shaped slot when said clamped portion is rotated with said annular wheel member, and a first coupling end extending from said guided key portion in the first transverse direction and rearward so as to extend rearwardly of said rear wall; and a retaining member disposed rearwardly of said rear wall and including a second coupling end to engage said first coupling end so as to cooperate with said grip portion, to stabilize movement of said guided key portion in said arc-shaped slot.

2. The packaging and displaying device of claim 1, wherein said ratchet mechanism includes teeth disposed on said annular bearing wall, and a pawl member disposed in said rim portion to engage said teeth.

3. The packing and displaying device of claim 2, wherein said pawl member is integrally formed with said rim portion and is configured to be resilient such that said teeth depresses said pawl member inwardly and radially of said rim portion against biasing action of said pawl member when said annular wheel member is rotated unidirectionally.

4. The packaging and displaying device of claim 1, wherein said spindle portion is formed with a split extending from said distal end towards said proximate end in the first transverse direction, said clamped portion including an inner surrounding wall which defines a cavity extending in the first transverse direction to be communicated with said socket end so as to permit extension of said distal end therethrough, said packaging and displaying device further comprising an insert member disposed to fit into said cavity so as to be positioned forwardly of said distal end.

5. The packaging and displaying device of claim 4, wherein said insert member includes a front portion fitted into said cavity, and a locking key portion disposed to extend rearwardly from said front portion and in the first transverse direction to be inserted into said split when said front portion is fitted into said cavity.

6. The packaging and displaying device of claim 5, wherein said locking key portion includes a distal segment disposed to be inserted into said split, and a proximate segment relative to said front portion, said inner surrounding wall including a guiding groove extending in the first transverse direction such that when said distal segment is brought to be inserted into said split, said proximate segment is brought to register with and to be retained in said guiding groove.

7. The packaging and displaying device of claim 1, wherein said grip portion includes a front section having left and right sides and extending in a second transverse direction which is transverse to both of the first transverse direction and the longitudinal direction, and two side sections extending rearwardly from said left and right sides, respectively, in the first transverse direction, said front section of said grip portion and said side sections together defining a receiving space adapted for accommodating the handle.

8. The packaging and displaying device of claim 1, further comprising a tool box body adapted to put away tools, said backing mount member being in the form of a cover having a rear side edge hinged to said tool box body.

9. The packaging and displaying device of claim 8, wherein said tool box body has an open top side, front and rear walls, and two lateral side walls to confine a receiving space adapted to receive tools therein, each of said lateral side walls being formed with a plate mounting groove, said tool box body further including a pair of tool retaining plates slidably disposed in said plate mounting grooves of said lateral side walls, said tool retaining plates being formed with aligned pairs of notches adapted to support shanks and handles of tools, said tool box body further including a tenon-and-mortise arrangement for removably retaining said tool retaining plates in said plate receiving grooves.

10. The packaging and displaying device of claim 9, wherein said front wall of said tool box body is provided with a fastening seat, said backing mount member including a fastening hook with a rivet hole for engaging said fastening seat, and a fastening rivet extended through said rivet hole to prevent lifting of said backing mount member from said tool box body.

11. The packaging and displaying device of claim 1, wherein said rear wall of said backing mount member is provided with two guide ribs that are disposed above and below said arc-shaped slot and that are spaced apart from said arc-shaped slot in radial directions so as to guide movement of said retaining member therebetween.

* * * * *